United States Patent [19]

Kaneko et al.

[11] Patent Number: 4,800,030

[45] Date of Patent: Jan. 24, 1989

[54] REFRIGERATOR OIL COMPOSITION

[75] Inventors: Masato Kaneko; Hiroshi Nagakawa, both of Ichihara; Kenichi Yamashita, Tokyo, all of Japan

[73] Assignee: Idemitsu Kosan Company Limited, Tokyo, Japan

[21] Appl. No.: 944,247

[22] Filed: Dec. 18, 1986

[30] Foreign Application Priority Data

Dec. 28, 1985 [JP] Japan ..... 60-299381
Dec. 28, 1985 [JP] Japan ..... 60-299382

[51] Int. Cl.[4] ..... C10M 137/02; C10M 137/04

[52] U.S. Cl. ..... 252/32.5; 252/49.8; 252/68; 252/78.5

[58] Field of Search ..... 252/32.5, 49.8, 68, 252/78.5; 558/164, 165

[56] References Cited

U.S. PATENT DOCUMENTS

| | | | |
|---|---|---|---|
| 2,411,671 | 11/1946 | Smith et al. | 252/49.8 |
| 2,632,767 | 3/1953 | Smith | 558/164 |
| 2,726,256 | 12/1955 | Morris et al. | 558/164 |
| 2,736,737 | 2/1956 | Morris | 252/46.6 |
| 2,909,559 | 10/1959 | Lanham | 252/78.5 |
| 3,245,979 | 4/1966 | Nelson et al. | 252/325 |
| 4,038,197 | 7/1977 | Caspari | 252/49.8 |
| 4,220,611 | 9/1980 | Wolf | 252/49.9 |
| 4,256,593 | 3/1981 | Nozawa | 252/49.8 |
| 4,612,128 | 9/1986 | Uematsu et al. | 252/325 |

*Primary Examiner*—Jacqueline V. Howard
*Attorney, Agent, or Firm*—Frishauf, Holtz, Goodman & Woodward

[57] ABSTRACT

The present invention, in one embodiment thereof, relates to a refrigerator oil composition comprising:
(1) mineral oil, synthetic oil of a mixture thereof; and
(2) at least one phosphorus compound.

In another embodiment, the present invention relates to a refrigerator oil composition comprising the above refrigerator oil composition and further containing triarylphosphoric acid ester.

In accordance with the present invention, there can be obtained a refrigerator oil composition which is greatly increased in extreme pressure properties and abration resistance.

10 Claims, No Drawings

REFRIGERATOR OIL COMPOSITION

BACKGROUND OF THE INVENTION

The present invention relates to a refrigerator oil composition and more particularly to a refrigerator oil which is excellent in extreme pressure properties and anti-wear properties and further is excellent in stability in the presence of refrigerants.

A refrigerator oil which is used in lubrication of sliding parts of a refrigerator is required to have good extreme pressure properties and anti-wear properties. In recent years, with employment of the inverter system in refrigerators, a refrigerator oil having excellent exteme pressure properties and anti-wear properties has been increasingly needed.

In order to impart extreme pressure properties and anti-wear properties to a refrigerator oil, it has been proposed to add phosphorus compounds to the refrigerator oil (see Japanese Patent Application Laid-Open No. 88007/1978, for example). Of these phosphorus compounds, tricresyl phosphate (TCP) is most widely used.

Refrigerator oils with the known phosphorus compounds added, however, are unsatisfactory in extreme pressure properties and anti-wear properties. In particular, a TCP added refrigerator oil has disadvantages in that (1) extreme pressure properties and anti-wear properties are poor, and (2) the stability in an atmosphere of a refrigerant is poor.

SUMMARY OF THE INVENTION

The present invention is intended to overcome the above problems and an object of the present invention is to provide a refrigerator oil composition which is excellent in extreme pressure properties and anti-wear properties, and further is excellent in stability in the presence of a refrigerant.

The present invention, in one embodiment thereof, relates to a refrigerator oil composition comprising:

(1) mineral oil, synthetic oil or a mixture thereof;

(2) at least one phosphorus compound selected from (A) phosphorus compounds containing at least two functional groups having the formula:

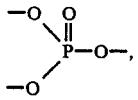

(B) phosphorus compounds containing at least two functional groups having the formula:

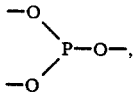

and (C) phosphorus compounds containing at least one functional group having the formula:

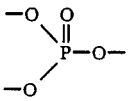

and at least one functional group having the formula:

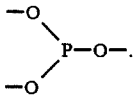

In another embodiment, the present invention relates to a refrigerator oil composition comprising the above refrigerator oil composition and further containing triarylphosphoric acid ester represented by the general formula (I):

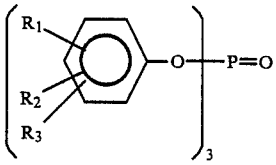

(I)

(wherein $R_1$, $R_2$ and $R_3$ each represent a hydrogen atom or an alkyl group having 1 to 20 carbon atoms). That is, the present invention relates to a refrigerator oil composition comprising:

(1) mineral oil, synthetic oil or a mixture thereof;

(2) at least one phosphorus compound selected from (A) phosphorus compounds containing at least two functional groups having the formula:

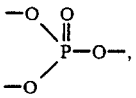

(B) phosphorus compound containing at least two functional groups having the formula:

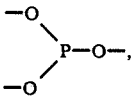

and (C) phosphorus compounds containing at least one functional group having the formula:

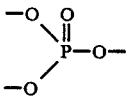

and at least one functional group having the formula:

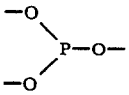

and (3) triarylphosphoric acid ester represented by the general formula (I).

DETAILED DESCRIPTION OF THE INVENTION

Component (1) of the composition of the present invention is mineral oil, synthetic oil or a mixture thereof, and constitutes a major portion of the composition. Although the properties of the mineral oil and synthetic oil are not critical, it is preferred to use mineral and synthetic oils having a dynamic viscosity (determined at 40° C.) falling within the range of 5 to 300 centistokes (cSt). Representative examples of the mineral oil are naphthenic mineral oil, intermediate mineral oil, a lubricating oil fraction of a paraffinic mineral oil, and high aromatic fractions obtained by decomposition of these mineral oils. Representative examples of the synthetic oil are polyolefin oils such as polyethylene, polypropylene and polybutene, straight chain alkylbenzene, branched alkylbenzene, alkylnaphthalene, ester oil and polyglycol oil. These oils can be used alone or in combination with each other. In addition, mineral oil and/or synthetic oil which are subjected to clay treatment can be used.

In the first invention, as Component (2), at least one phosphorus compound selected from:

(A) phosphorus compounds containing at least two functional groups having the formula:

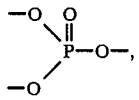

(B) phosphorus compounds containing at least two functional groups having the formula:

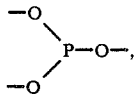

and (C) phosphorus compounds containing at least one functional group having the formula:

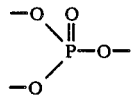

and at least one functional group having the formula:

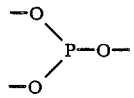

is compounded to a mineral oil and/or a synthetic oil as described above.

As the phosphorus compound (A), any compounds containing at least two functional groups represented by the formula (Functional Group I):

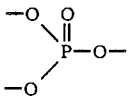

can be used. Representative examples of the phosphorus compound (A) are:

phosphorus compounds represented by the general formula:

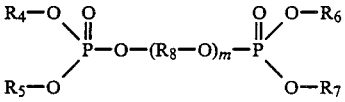

(wherein $R_4$ to $R_7$ each represent a radical having 1 to 30 carbon atoms selected from an alkyl group, an alkylaryl group, a cycloalkyl group, an aryl group, an alkylcycloalkyl group, an alkylhydroxyl group, an oxyalkyl group, and a thioalkyl group, $R_8$ represents a radical having 1 to 10 carbon atoms selected from an alkylene group, an alkyl-substituted phosphate and an alkyl-substituted phosphite, and m prepresents a number of 1 to 4), phosphorus compounds represented by the general formula:

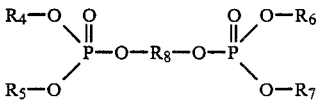

(wherein $R_4$ to $R_7$ and $R_8$ are the same as defined above), phosphorus compounds represented by the general formula:

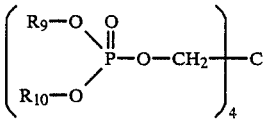

(wherein $R_9$ and $R_{10}$ each represent a radical having 1 to 30 carbon atoms selected from an alkyl group, an alkylaryl group, a cycloalkyl group, an aryl group, an alkylcycloalkyl group, an alkylhydroxy group, an oxyalkyl group and a thioalkyl group), a phosphorus compound having the formula:

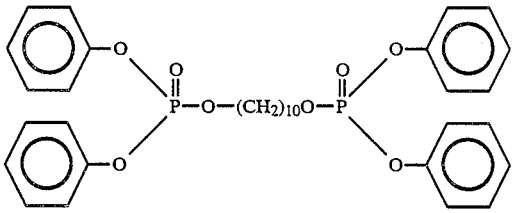

a phosphorus compound having the formula:

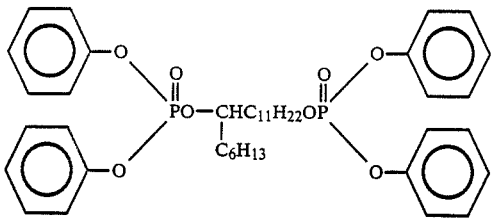
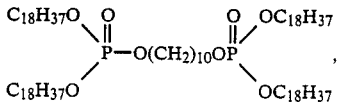
a phosphorus compound having the formula:
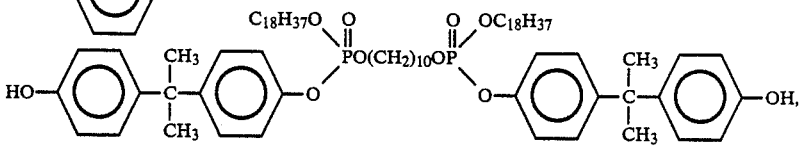
a phosphorus compound having the formula:
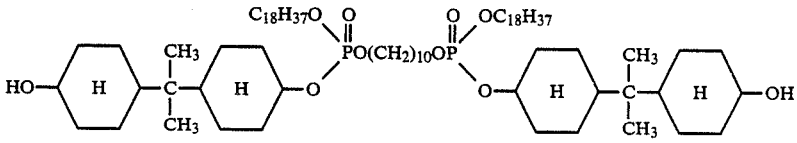
a phosphorus compound having the formula:
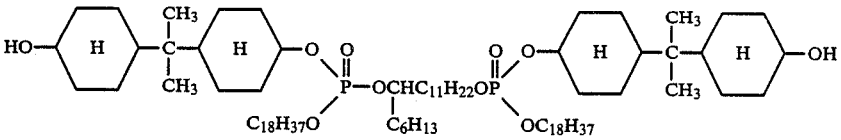
a phosphorus compound having the formula:
a phosphorus compound having the formula:
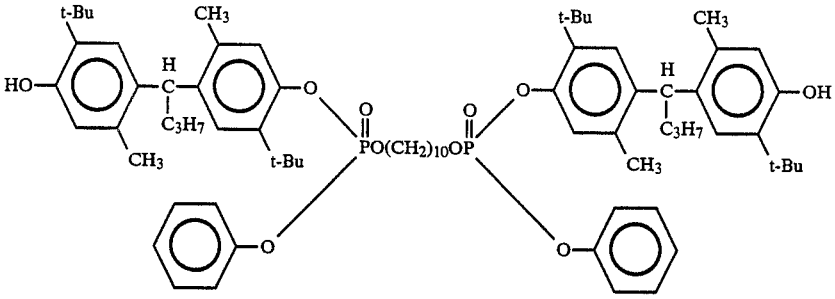
a phosphorus compound having the formula:
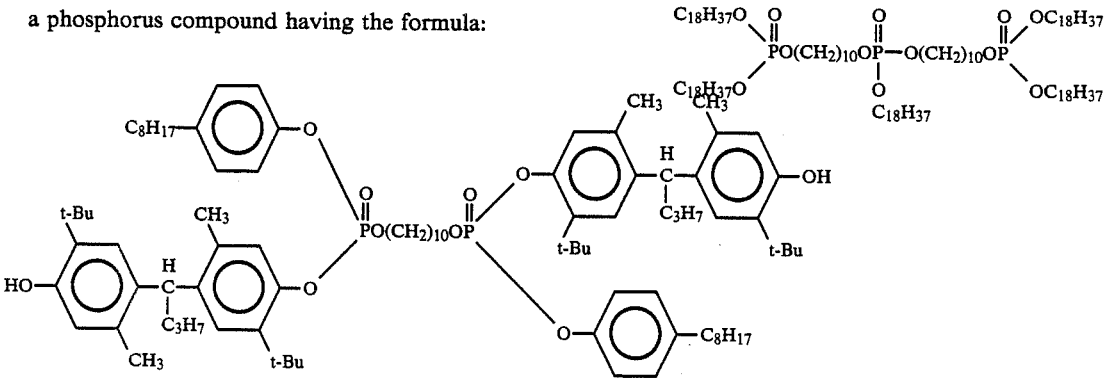
a phosphorus compound having the formula:

a phosphorus compound having the formula:

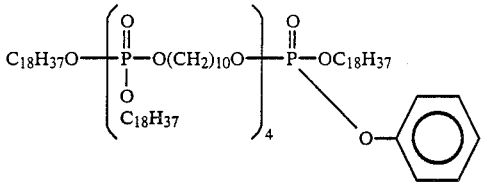

phosphorus compounds represented by the general formula:

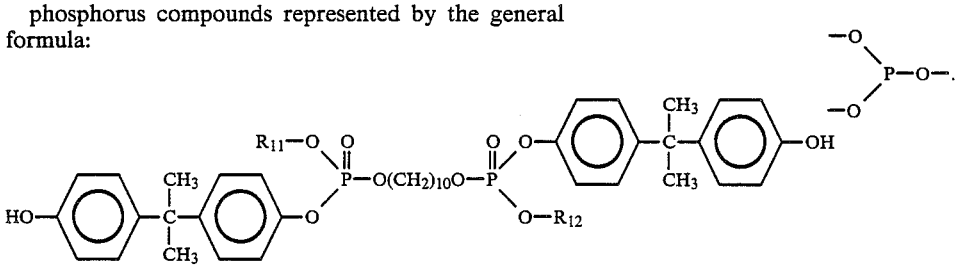

(wherein $R_{11}$ and $R_{12}$ each represent an alkyl group having 12 to 15 carbon atoms), a phosphorus compound having the formula:

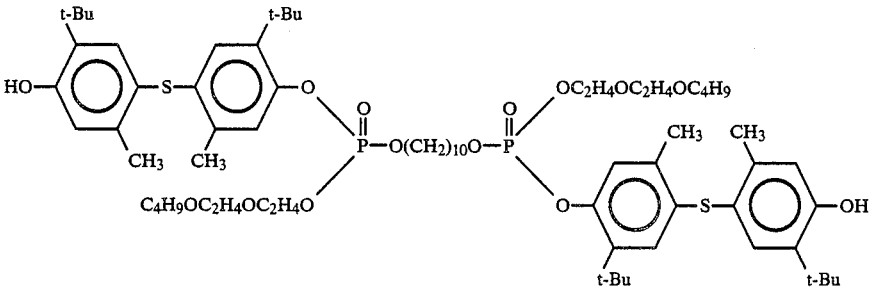

a phosphorus compound having the formula:

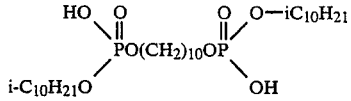

and a phosphorus compound having the formula:

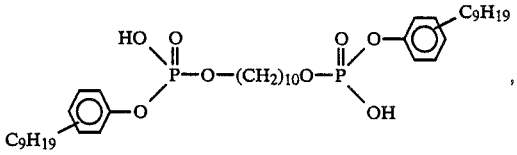

As the phosphorus compound (B), any compound having at least two functional groups having the formula (Functional Group II):

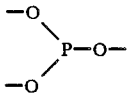

can be used. Representative examples of the phosphorus compound (B) are the same compounds as listed above as the compound (A) with the exception that the functional group having the formula (Functional Group I):

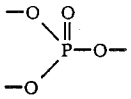

is replaced with the functional group having the formula (Functional Group II):

Preferred examples are:

phosphorus compounds represented by the general formula:

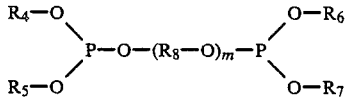

(wherein $R_4$ to $R_7$, $R_8$ and m are the same as defined above), phosphorus compounds represented by the general formula:

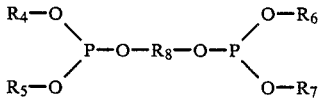

(wherein $R_4$ to $R_7$ and $R_8$ are the same as defined above), and phosphorus compounds represented by the general formula:

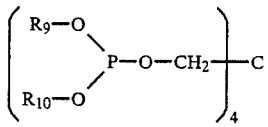

(wherein $R_9$ and $R_{10}$ are the same as defined above).

As the phosphorus compound (C), any compounds containing at least one Functional Group I and at least one Functional Group II can be used.

The phosphorus compound (A) includes only phosphorus compounds containing at least two Functional Group I in the molecule thereof and excludes compounds containing at least one Functional Group II. Similarly the phosphorus compound (B) includes only phosphorus compounds containing at least two Functional Groups II and excludes compounds containing at least one Functional Group I. The phosphorus compound (C) includes various phosphorus compounds, such as phosphorus compounds as listed above as the phosphorus compound (A) wherein one of the functional groups I is replaced with one functional group II or wherein one functional group I is left unreplaced and other all functional groups I are replaced with functional groups II.

In accordance with the present invention, the phosphorus compounds (A) and (C) are compounded to the above mineral oil and/or synthetic oii, alone or in combination with each other, or further in combination with the phosphorus compound (B).

The amount of the above phosphorus compound (Component (2) compounded to the above mineral oil and/or synthetic oil (Component (1)) is 0.001 to 10 parts by weight, preferably 0.005 to 9 parts by weight and more preferably 0.009 to 5 parts by weight per 100 parts by weight of the component (1). If the amount of the component (2) compounded is less than 0.001 part by weight, the effect of increasing extreme pressure properties and abrasion resistance is not sufficiently high. On the other hand, if the amount of the component (2) compounded is in excess of 10 parts by weight, the solubility is poor, and the oil becomes cloudy and causes precipitation.

In the second invention, at least one phosphorus compound (Component (2)) selected from the above phosphorus compounds (A), (B) and (C) is compounded to the above mineral oil and/or synthetic oil (Component (1)) in combination with triarylphosphoric acid ester (Component (3)) as described hereinafter.

The amount of the phosphorus compound compounded is usually 0.001 to 10 parts by weight, preferably 0.005 to 9 parts by weight and more preferably 0.01 to 3 parts by weight per 100 parts by weight of the above mineral oil and/or synthetic oil. If the amount of the phosphorus compound compounded is less than 0.001 parts by weight, the effect of increasing extreme pressure properties and abrasion resistance is not sufficiently high. On the other hand, if the amount of the phosphorus compound compounded is in excess of 10 parts by weight, the solubility is poor, and the oil becomes cloudy and causes precipitation.

The triarylphosphoric acid ester represented by the above general formula (I) is used as Component (3) in the second invention. In the general formula (I), $R_1$, $R_2$ and $R_3$ each represent a hydrogen atom or a radical having 1 to 30 carbon atoms selected from an alkyl group, an alkylaryl group, a cycloalkyl group, an aryl group, an alkylcycloalkyl group, an alkylhydroxy group, an oxyalkyl group and a thioalkyl group. Examples of the alkyl group are a methyl group, an ethyl group, a propyl group, and a butyl group. Representative examples of the triarylphosphoric acid ester are triphenyl phosphate, tri(monoalkyl-substituted aryl) phosphates such as tricresyl phosphate, tri(dialkylsubstituted aryl) phosphates such as trixylenyl phosphate, tripseudocumenyl phosphate, trihemimeritenyl phosphate, and tri(trialkyl-substituted aryl) phosphates such as trimesitylenyl phosphate.

The amount of the triarylphosphoric acid ester compounded is usually 0.01 to 10 parts by weight and preferably 0.1 to 6 parts by weight per 100 parts by weight of the above mineral oil and/or synthetic oil. If the amount of the triarylphosphoric acid ester compounded is less than 0.01 part by weight, the effect of increasing extreme pressure properties and abrasion resistance is not sufficiently high. On the other hand, if the amount of the triarylphosphoric acid ester compounded is in excess of 10 parts by weight, thermal stability is decreased and furthermore insoluble substances are precipitated.

The refrigerator oil composition of the present invention is prepared by adding the above phosphorus compound (first invention) or the above phosphorus compound and triarylphosphoric acid ester (second invention) to the above mineral oil and/or synthetic oil as a base oil. If necessary, phenol-based or phosphorus-based antioxidants, silicon-based or ester-based defoaming agents, glycidyl ether-based, polyglycol-based or organo-tin-based corrosion preventing agents, and so on can be added to the refrigerator oil composition of the present invention.

In accordance with the first invention, there can be obtained a refrigerator oil composition which is greatly increased in extreme pressure properties and anti-wear properties. Furthermore, this composition is good in stability in an atmosphere of a refrigerant.

The second invention provides a refrigerator oil composition which is more improved over the composition of the first invention.

Accordingly the refrigerator oil composition of the present invention can be effectively used in lubrication of sliding parts of a refrigerator.

The present invention is described in greater detail with reference to the following examples.

EXAMPLES 1 TO 17, AND COMPARATIVE EXAMPLES 1 TO 2

(1) Preparation of Base Oil

A naphthenic mineral oil (dynamic viscosity: 30 cSt (40° C.)) was subjected to clay treatment to prepare a base oil A.

Alkylbenzene (ABH-SH, produced by Mitsubishi Yuka Co., Ltd.) was subjected to clay treatment to prepare a base oil B.

(2) Preparation of Refrigerator Oil Composition

Refrigerator oil compositions having various formulations were prepared by adding predetermined amounts of phosphorus compounds shown in Table 1 to 100 parts by weight of the base oil obtained in (1) above.

(3) Evaluation of Refrigerator Oil Composition in Respect of Extreme Pressure Properties, Abrasion Resistance and Stability in an Atmosphere of a Refrigerant The above prepared various refrigerator oil compositions were measured for extreme pressure properties, abrasion resistance and stability in an atmosphere of a refrigerant by the methods as described below. The results are shown in Table 1.

Extreme Pressure Properties

The Falex test (Falex seizure load test) was performed according to ASTM D 2670 to evaluate the extreme pressure properties.

Anti-Wear Properties

The wear amount (mg) was measured by performing the Falex test (Falex wear properties test) according to ASTM D 2670 under conditions of load 300 LBS and 2 hours to evaluate the anti-wear properties.

Stability in an Atmosphere of a Refrigerant

The sealed tube test was performed, and the amount of hydrochloric acid formed (mg HCl/4 ml) was measured and changes in the appearance of the catalyst and oil were examined to evaluate the stability in an atmosphere of a refrigerant. The test conditions were as follows.

(1) Tube: Ampule made of pyrex glass and having pressure resistance of 20 kg/cm and an inner volume of 10 ml.
(2) Sample: Each 4 ml
(3) Refrigerant: 2 g of $CF_2Cl_2$ (trade name: Daifuron-12: produced by Daikin Kogyo Co., Ltd.)
(4) Catalyst: Piece of each of Cu, Fe and Al (diameter: 1.6 mm; length: 40 mm)
(5) Temperature, Time: 175° C., 720 hours After the test, the ampule was thoroughly cooled with liquefied nitrogen and then opened. The open end of the ampule was placed in about 100 ml of distilled water to make the hydrochloric acid formed absorbed in the distilled water. The amount of hydrochloric acid formed was calculated by titrating with a 0.1N potassium hydroxide solution. At the same time, changes in the appearance of the catalyst copper piece and the oil were examined.

TABLE 1

| | | Phosphorus Compound | | Falex Test | | Sealed Tube Test | | |
|---|---|---|---|---|---|---|---|---|
| | Base Oil Type | Type | Amount (parts by weight) | Seizure Load (LBS) | Anti-wear Properties (mg) | Amount of Hydrochloric Acid formed (mg HCl/4 ml) | Appearance of Catalyst | Appearance of Oil |
| Example 1 | A | Compound 1*1 | 0.05 | 540 | 6.8 | 0.19 | good | good |
| Example 2 | " | " | 0.1 | 550 | 5.9 | 0.19 | " | " |
| Example 3 | " | " | 0.2 | 1600 | 4.8 | 0.19 | " | " |
| Example 4 | " | " | 0.5 | 1650 | 4.5 | 0.20 | " | " |
| Example 5 | " | " | 1.0 | 1700 | 4.2 | 0.18 | " | " |
| Example 6 | B | " | 0.5 | 1600 | 4.8 | 0.19 | " | " |
| Example 7 | A | Compound 2*2 | 0.05 | 500 | 6.9 | 0.19 | " | " |
| Example 8 | " | " | 0.1 | 560 | 6.2 | 0.19 | " | " |
| Example 9 | " | " | 0.2 | 620 | 5.3 | 0.19 | " | " |
| Example 10 | " | " | 0.5 | 1100 | 5.0 | 0.11 | " | " |
| Example 11 | " | " | 1.0 | 1200 | 5.0 | 0.10 | " | " |
| Example 12 | B | " | 0.5 | 1100 | 5.2 | 0.10 | " | " |
| Example 13 | A | Compound 3*3 | 0.5 | 950 | 4.8 | 1.2 | " | " |
| Example 14 | " | " | 1.0 | 1000 | 4.5 | 1.2 | " | " |
| Example 15 | " | Compound 4*4 | 0.5 | 850 | 6.2 | 1.1 | good | good |
| Example 16 | " | " | 1.0 | 900 | 6.0 | 1.1 | " | " |
| Example 17 | " | Compound 3<br>Compound 4 | 0.5<br>0.5 | 900 | 4.8 | 1.0 | " | " |
| Comparative Example 1 | " | — | — | 400 | unmeasurable | 3.0 | " | " |
| Comparative | " | TCP*5 | 1.0 | 600 | 11.0 | 30< | blackened | blackened |

TABLE 1-continued

| | Base Oil Type | Phosphorus Compound Type | Phosphorus Compound Amount (parts by weight) | Falex Test Seizure Load (LBS) | Falex Test Anti-wear Properties (mg) | Sealed Tube Test Amount of Hydrochloric Acid formed (mg HCl/4 ml) | Sealed Tube Test Appearance of Catalyst | Sealed Tube Test Appearance of Oil |
|---|---|---|---|---|---|---|---|---|
| Example 2 | | | | | | | | |

*1Compound 1

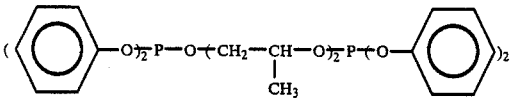

*2Compound 2

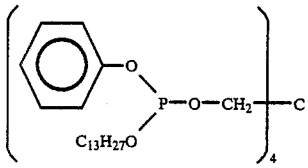

*3Compound 3

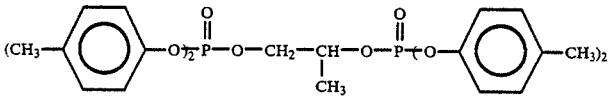

*4Compound 4

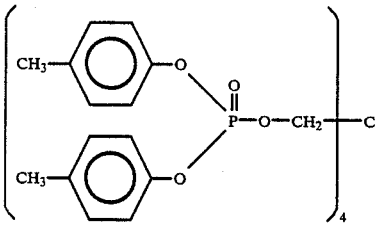

*5Tricresyl phosphate

EXAMPLES 18 TO 23

(1) Preparation of Base Oil

A naphthenic mineral oil (dynamic viscosity: 30 cSt (40° C.)) was subjected to clay treatment to prepare a base oil A.

(2) Preparation of Refrigerator Oil Composition

Various refrigerator oil compositions were prepared by adding predetermined amounts of phosphorus compounds and triarylphosphoric acid esters as shown in Table 1 to 100 parts by weight of the base oil as obtained in (1) above.

(3) Extreme Pressure Properties, Anti-wear Properties and Stability in an Atmosphere of a Refrigerant The above prepared refrigerator oil compositions were measured for extreme pressure properties, anti-wear properties and stability in an Atmosphere of a Refrigerant in the same manner as in Examples 1 to 17. The results are shown in Table 1.

TABLE 2

| Example No. | Base Oil | Amounts (parts by weight) Phosphorus Compound | Amounts (parts by weight) Triaryl-phosphoric Acid Ester | Falex Test Seizure Load (LBS) | Falex Test Antiwear Properties (mg) | Sealed Tube Test Amount of Hydrochloric Acid formed (mg HCl/4 ml) | Sealed Tube Test Appearance of Catalyst | Sealed Tube Test Appearance of Oil |
|---|---|---|---|---|---|---|---|---|
| 18 | A | Compound 1*1 0.1 | TCP*5 1.0 | 850 | 4.9 | 0.1 > | good | good |
| 19 | " | Compound 1*1 0.05 | TCP*5 0.5 | 800 | 5.5 | 0.1 > | " | " |
| 20 | " | Compound 2*2 0.1 | TCP 1.0 | 780 | 5.7 | 0.1 > | " | " |
| 21 | " | Compound 2*2 0.05 | TCP 0.5 | 750 | 6.0 | 0.1 > | " | " |
| 22 | " | Compound 3*3 0.1 | TCP 1.0 | 800 | 6.9 | 0.9 | " | " |
| 23 | " | Compound 4*4 0.1 | TCP 1.0 | 750 | 7.3 | 1.1 | " | " |

*1~*5: Same as in Table 1

What is claimed is:

1. A refrigerator oil composition comprising:

(1) mineral oil, synthetic oil or a mixture thereof; and (2) at least one phosphorus compound selected from the group consisting of a phosphorus compound represented by the general formula:

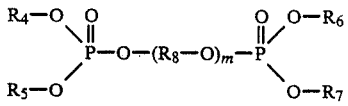

wherein $R_4$ to $R_7$ each represent a radical having 1 to 30 carbon atoms selected from an alkyl group, an alkylaryl group, a cycloalkyl group, an aryl group, an alkylcycloalkyl group, an alkylhydroxy group, an oxyalkyl group and a thioalkyl group, $R_8$ represents a radical having 1 to 10 carbon atoms selected from an alkyl-substituted phosphate and an alkyl-substituted phosphite, and m represents a number of 1 to 4, a phosphorus compound represented by the general formula:

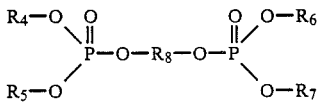

wherein $R_4$ to $R_7$ and $R_8$ are the same as defined above, a phosphorus compound represented by the general formula:

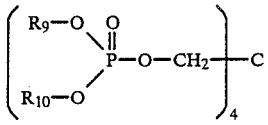

wherein $R_9$ and $R_{10}$ each represent a radical having 1 to 30 carbon atoms selected from an alkyl group, an alkylaryl group, a cycloalkyl group, an aryl group, an alkylcycloalkyl group, an alkylhydroxy group, an oxyalkyl group and a thioalkyl group, a phosphorus compound represented by the general formula:

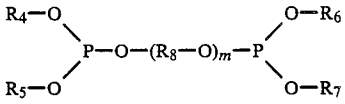

wherein $R_4$ to $R_7$, $R_8$ and m are the same as defined above, a phosphorus compound represented by the general formula:

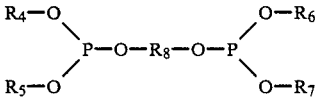

wherein $R_4$ to $R_7$ and $R_8$ are the same as defined above, and a phosphorus compound represented by the general formula:

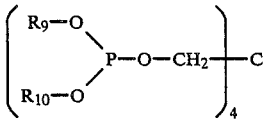

wherein $R_9$ and $R_{10}$ are the same as defined above; wherein the amount of Component (2) added is from 0.001 to 10 parts by weight per 100 parts by weight of Component (1).

2. The composition as claimed in claim 1, wherein the amount of Component (2) added is from 0.005 to 9 parts by weight per 100 parts by weight of Component (1).

3. The composition as claimed in claim 1, wherein the amount of Component (2) added is from 0.009 to 5 parts by weight per 100 parts by weight of Component (1).

4. A refrigerator oil composition comprising:

(1) mineral oil, synthetic oil or a mixture thereof;

(2) at least one phosphorus compound selected from the group consisting of a phosphorus compound represented by the general formula:

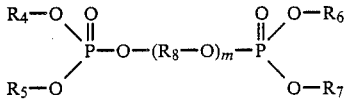

wherein $R_4$ to $R_7$ each represent a radical having 1 to 30 carbon atoms selected from an alkyl group, an alkylaryl group, a cycloalkyl group, an aryl group, an alkylcycloalkyl group, an alkylhydroxy group, an oxyalkyl group and a thioalkyl group, $R_8$ represents a radical having 1 to 10 carbon atoms selected from an, an alkyl-substituted phosphate and an alkyl-substituted phosphite, and m represents a number of 1 to 4, a phosphorus compound represented by the general formula:

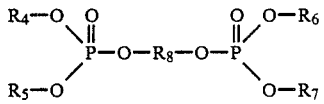

wherein $R_4$ to $R_7$ and $R_8$ are the same as defined above and (3) triarylphosphoric acid ester represented by the general formula:

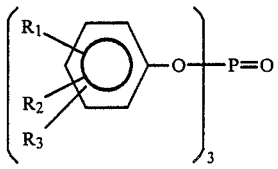

wherein $R_1$, $R_2$ and $R_3$ each represent a hydrogen atom or an alkyl group having 1 to 20 carbon atoms; wherein the amount of Component (2) added is from 0.001 to 10 parts by weight and the amount of Component (3) added is from 0.001 to 10 parts by weight per 100 parts by weight of Component (1).

5. The composition as claimed in claim 4, wherein the amount of Component (2) added is from 0.001 to 10 parts by weight per 100 parts by weight of Component (1).

6. The composition as claimed in claim 4, wherein the amount of Component (2) added is from 0.005 to 9 parts by weight per 100 parts by weight of Component (1).

7. The composition as claimed in claim 4, wherein the amount of Component (2) added is from 0.01 to 3 parts by weight per 100 parts by weight of Component (1).

8. The composition as claimed in claim 4, wherein the amount of Component (3) added is from 0.001 to 10 parts by weight per 100 parts by weight of Component (1).

9. The composition as claimed in claim 4, wherein the amount of Component (3) added is from 0.1 to 6 parts by weight per 100 parts by weight of Component (1).

10. The composition as claimed in claim 4, wherein the amount of Component (2) added is from 0.005 to 9 parts by weight and the amount of Component (3) added is from 0.1 to 6 parts by weight per 100 parts by weight of Component (1).

* * * * *

UNITED STATES PATENT AND TRADEMARK OFFICE

CERTIFICATE OF CORRECTION

PATENT NO. : 4,800,030

DATED : January 24, 1989

INVENTOR(S) : KANEKO et al

It is certified that error appears in the above-identified patent and that said Letters Patent is hereby corrected as shown below:

Column 15, line 9 (second line under left formula at top of page), delete ", a phosphorus compound represented by the" and insert -- ; --.

Column 15, line 10 through line 51, delete in entirety, i.e. delete "general formula: ... wherein $R_9$ and $R_{10}$ are the same as defined above;"

Signed and Sealed this

Twenty-seventh Day of April, 1993

*Attest:*

MICHAEL K. KIRK

*Attesting Officer*

*Acting Commissioner of Patents and Trademarks*